US005245822A

United States Patent [19]

Laguinia

[11] Patent Number: 5,245,822

[45] Date of Patent: Sep. 21, 1993

[54] COMPACT TURBINE ASSEMBLY

[75] Inventor: Enrique L. Laguinia, Quezon City, Philippines

[73] Assignee: Goodfire Stoves Corporation, Metro Manila, Philippines

[21] Appl. No.: 836,254

[22] Filed: Feb. 18, 1992

[30] Foreign Application Priority Data

May 16, 1991 [PH] Philippines ..... 42462

[51] Int. Cl.[5] ..... F02C 7/00; F01D 1/34

[52] U.S. Cl. ..... 60/39.75; 415/92

[58] Field of Search ..... 60/39.44, 39.75; 415/92, 173.5, 174.5, 202

[56] References Cited

U.S. PATENT DOCUMENTS 949,440 2/1910 Richardson et al. ..... 415/174.5
1,194,507 8/1916 Keppler ..... 415/202
4,519,744 5/1985 Arold ..... 415/92

FOREIGN PATENT DOCUMENTS 317580 1/1902 France ..... 415/92
319746 6/1912 France ..... 415/92

*Primary Examiner*—Louis J. Casaregola
*Attorney, Agent, or Firm*—Mason, Fenwick & Lawrence

[57] ABSTRACT

A compact turbine assembly that may be driven by a variety of compressed fluids, including superheated steam, compressed air, pressurized water, or combustion exhaust gas. The turbine assembly employs a rotor which includes a series of fluid medium-receiving cavities having rounded closed ends. The turbine assembly may include a gap section between the power housing rim and the rotor of the device, in order to maximize use of the enthalpy of the fluid medium to drive the rotor.

7 Claims, 2 Drawing Sheets

COMPACT TURBINE ASSEMBLY

BACKGROUND OF THE INVENTION

1. Field of the Invention

The present invention relates in general to prime movers, and more particularly to a compact turbine assembly adapted to operate with a fluid medium generated from a generating means attached thereto.

2. Description of the Prior Art

Conventional turbines known in the art are complicated in their design and are adapted to operate under relatively large capacities. Steam engines installed in power plants are likewise cumbersome and complicated in their design. Because of their size, the use of boilers and turbines or engines of such type has been limited to stationary power generation applications. Thus, the application of adaptation of such machines to the field of light farm machinery or equipment and the like has been minimal, if not non-existent.

SUMMARY OF THE INVENTION

The present invention seeks to overcome the shortcomings and disadvantages of the prior art by providing a compact turbine assembly that is simple in design and capable of producing just enough power output to supply the needs of light farm machinery or equipment and the like. The present invention is designed to provide a localized power supply that is independent of a domestic or household power supply coming from a power plant or station.

It is therefore the main object of the present invention to provide a compact turbine assembly that is capable of supplying small scale power requirements for light farm machinery and equipment.

Another object of the invention is to provide a turbine assembly that employs a turbine including a series of cavities having rounded closed ends, the cavities being disposed at an angle along the outer circumferential surface of the turbine's rotor, so as to avoid the complexity of tier-shaped blades and vanes conventionally utilized in the art. The built-in cavities serve as vanes on which superheated steam, or other pressurized fluid medium, pushes or applies force.

Still another object of the invention is to provide a turbine assembly that can be mass-produced and manufactured using indigenous materials and local technology, thereby making the product very competitive compared with known products, without sacrificing the efficiency or quality of the turbine assembly produced.

Yet another object of the invention is to provide a turbine assembly that can be driven by any of the following fluid mediums, namely: superheated steam, compressed air, pressurized water, or combustion exhaust gas.

BRIEF DESCRIPTION OF THE DRAWINGS

These and other objects, features and advantages of the present invention will become apparent and will be appreciated upon reading the following detailed description of the invention in conjunction with the appended drawings, in which.

DETAILED DESCRIPTION OF THE INVENTION

Figure 1:
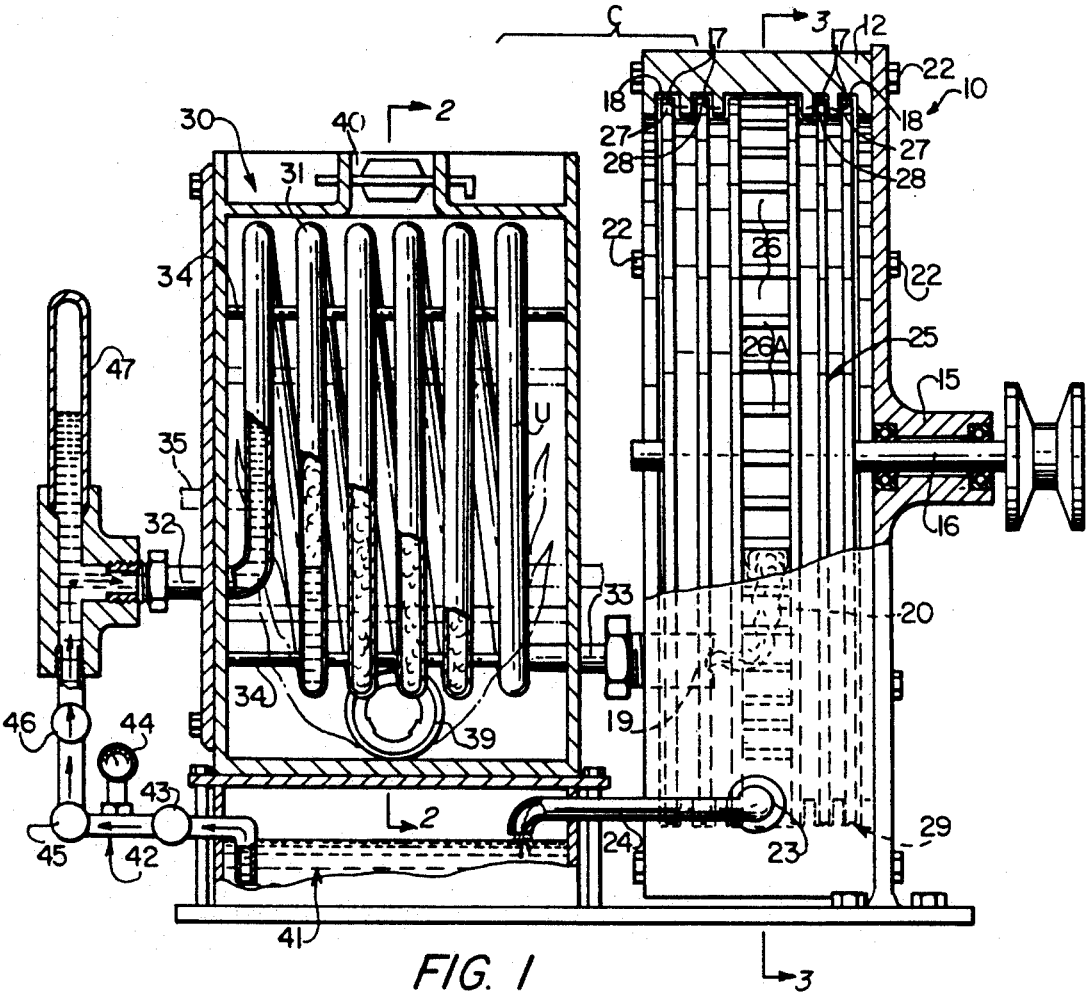
FIG. 1 is a cross-sectional view of the steam generator and turbine assembly as embodied in the present invention.

Referring now to the drawings in detail wherein like reference numerals designate the same parts all throughout therein, there is shown in FIG. 1 a turbine 10 adapted to operate with steam as a fluid medium. The steam is generated by a steam generator 11 installed in communication with turbine 10 in a manner to form a compact turbine assembly C, as shown in the same figure in cross-section. The steam generator herein illustrated is a matter of preference for purposes of showing a preferred embodiment of a fluid medium generating means which the present turbine is associated with or dependent upon in operation.

Turbine 10 comprises a power housing rim 12 consisting of two halves 13 fixedly anchored to a mounting support plate 14 having a central bearing housing 15 in which a power shaft 16 is rotatably mounted. Power housing rim 12 has two sets of alternate teeth and grooves 17 and 18, respectively, disposed circumferentially along the inside surface thereof. One or more steam inlet ports 19 and nozzles 20 are provided on the power rim 12. A plurality of attachment holes 21 support the two halves of power housing rim 12 together in the assembly, by accommodating bolts 22 screwably secured onto the support plate. Exhaust port 23 having exhaust pipe 24 is provided at the lower portion of the rim 12 to facilitate the exit of used steam from the turbine.

Figure 3:
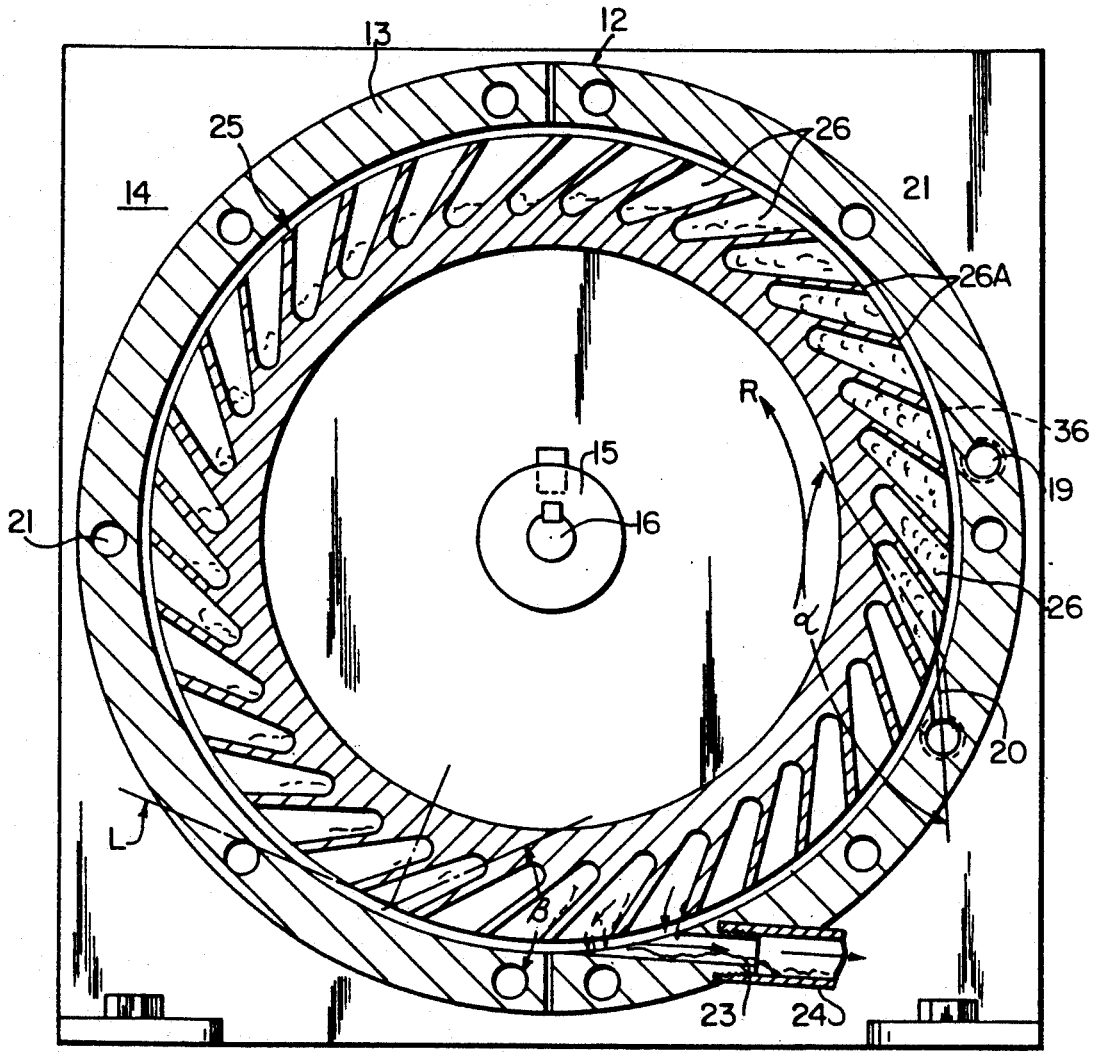
FIG. 3 is a cross-sectional view thereof taken along line 3—3 of FIG. 1.

A rotor 25 is keyed onto the power shaft inwardly of rim 12. Rotor 25 has a series of buckets or cavities 26 having rounded closed ends; the cavities 26 are disposed at an angle along the outer circumferential surface of the rotor. These cavities 26 are cast or machined into the outer circumferential surface of the rotor, and are arranged juxtaposedly such that adjacent cavities are separated by partitions 26A, which serve as common walls between cavities. The inclusive angle between each cavity 26 and the nozzle 20 as shown in FIG. 3 is preferably at obtuse angle, in order for the steam to effectively apply an impulse against the inside wall of the cavity. The angle of inclination of the cavity with respect to a tangential line L on its opening along the outer circumference of the rotor is preferably at least 45-degrees.

The cavities 26 are interposed along the width of the rotor by two sets of circumferential alternate grooves and teeth 27 and 28, respectively, which match with corresponding teeth 17 and grooves 18 of the rim 12 in the turbine assembly. This arrangement forms a labyrinth-shaped gap section 29 between the rim and rotor, leaving a clearance small enough to produce a sealing effect on the fluid medium in the transverse direction during operation of the turbine.

The steam generator comprises a fire chamber 30 that houses a coiled boiler tubing 31 having a fluid inlet 32 and outlet 33. The boiler tubing is anchored on hanger rods 34. Additional tubing 35 (shown in phantom in FIGS. 1 and 2) may be provided in the generator as desired to produce a greater power output. Additional tubing 35, when employed, is accompanied by an additional inlet port and nozzle 36 provided in the rim. A draft baffle 37 is provided at the top portion of the fire chamber 30, and a burner port 38 provided with a pressurized burner 39 is provided at the power portion thereof. A chimney 40 is provided on the fire chamber 30 to house the baffle. A feedwater tank 41 is mounted beneath the generator to communicate with the boiler tubing through a piping arrangement 42 provided with a water pump 43, pressure gauge 44, regulator valve 45, and check valve 46. To control the back pressure that may be produced during operation, a surge tubing 47 is provided just before the inlet section of the boiler tubing. The water tank 41 is also in communication with the exhaust port 23 of the rim through pipe 24. The outlet 33 of the tubing is attached to the inlet port 19 of the rim to facilitate the feeding of superheated steam produced in the upstream section u of the tubing into the turbine.

In operation, the cavities 26 of rotor 25 receive an initial injection of superheated steam from the nozzle 20. The impulse pushes the cavities forward thereby making the rotor begin to rotate. The rotation of the rotor is caused by the impulse applied on each cavity by the superheated steam coming out of the nozzle and thereafter by a reactive force against the rim due to the entrapment of the steam within the cavity. In subsequent positions of the cavities after passing through the nozzle, the entrapped steam recoils, giving a corresponding push against the power rim. The steam trapped in the cavity continuously pushes against the power rim until the enthalpy of the steam is utilized. Because of the labyrinth seal, the steam released from the cavities is entrained within the gap section, contributing to the efficiency of the turbine and the turbine assembly as a whole. Steam is discharged through the exhaust port and exhaust pipe and is condensed in the water tank, then recirculated or recycled. All cavities receive the same amount of steam injection in a cascading sequence. Additional nozzles would greatly increase the power output of the turbine.

Figure 2:
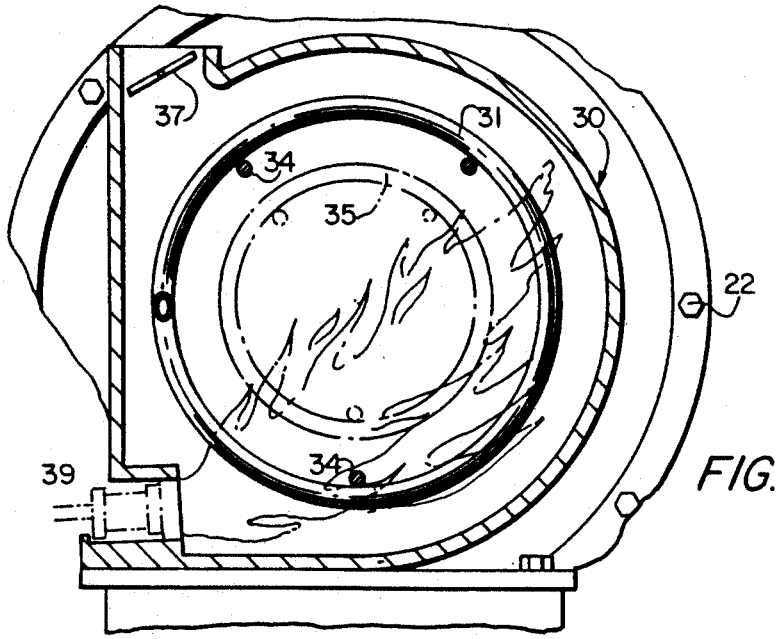
FIG. 2 is a cross-sectional view thereof taken along line 2—2 of FIG. 1.

As shown in FIGS. 1 and 2, operation of the turbine assembly is commenced by igniting the pressure burner so as to heat the coiled boiler tubing. The heated boiler tubing is the ready to receive the feedwater from the inlet thereof. The water pump is started and allowed to operate until the desired pressure indicated by the pressure gauge is attained. With the control valve opened, feedwater passes through the check valve into the inlet of the boiler tubing. The entry of feedwater fills up the downstream portion of the tubing until the water reaches its boiling point, forming steam somewhere at the middle section until reaching a saturation state, and finally forming dry steam and superheated steam at the upstream section thereof to be discharged through the nozzle.

At a certain stage in the entry of feedwater an abrupt change in pressure will occur. The surge tube is used to cushion and stabilize this occurrence and provides a smoother flow of steam pressure. The entry of the superheated steam pressure through the nozzle completes a cycle. Except for slight leakage through the labyrinth seal, minimal feedwater replenishment is needed.

For simplicity and clarity, only the preferred embodiment of the invention has been illustrated. However, additional boilers may be provided which would greatly increase the power output, or other fluid mediums may be used to produce substantially the same result, for instance, utilizing compressed air, pressurized water or combustion exhaust gas as may be deemed practical and applicable under certain conditions. These modifications and/or preferences do not depart from the teachings and principles of the present invention, and are intended to be covered by the scope of the following claims.

What is claimed is:

1. A compact turbine assembly, which comprises:

(a) a fluid medium generating means adapted to generate a high pressure fluid medium; and (b) a turbine connected to the fluid medium generating means, which comprises:

(i) a mounting support plate having a central bearing housing;

(ii) a power housing rim comprising two halves fixedly attached to the mounting support plate, the power housing rim having a plurality of alternate teeth and grooves disposed circumferentially along the inside surface of the power housing rim;

(iii) a power shaft rotatably mounted within the central bearing housing;

(iv) a rotor fixedly keyed onto the power shaft, the rotor having a series of fluid medium-receiving cavities, each cavity having an inner wall and a rounded closed end, the cavities being disposed at an angle along the outer circumferential surface of the rotor, the rotor including a plurality of circumferential alternate grooves and teeth which match respectively with the teeth and grooves of the power housing rim so as to form a labyrinth seal which defines a gap section between the power housing rim and the rotor, the cavities being in communication with the gap section and fluid medium released by the cavities being entrained in the gap section, wherein the gap section entraps the fluid medium during operation of the turbine in order to further drive the rotor and utilize the enthalpy of the fluid medium;

(v) at least one inlet port provided on the power housing rim, for admitting the high pressure fluid medium from the fluid medium generating means, and a nozzle connected to the inlet port, for directing the fluid medium to the rotor, wherein the inner wall of each fluid medium-receiving cavity against which the fluid medium first impinges is disposed at an obtuse angle along the outer circumferential surface of the rotor, as measured with respect to the direction of entry of the fluid medium into each cavity from the nozzle; and (vi) at least one exhaust port provided on the lower portion of the power housing rim, for passing used fluid medium out of the turbine, the exhaust port being in communication with the gap section and the gap section providing an outflow path to the exhaust port for the fluid medium entrained within the gap section.

2. The compact turbine assembly of claim 1, wherein the angle of inclination of each cavity is at least 45 degrees with respect to a tangent at the opening of each cavity along the outer circumference of the rotor.

3. The compact turbine assembly of claim 1, wherein the fluid medium generator is a steam generator, and the fluid medium is superheated steam.

4. The compact turbine assembly of claim 1, wherein the fluid medium is pressurized water.

5. The compact turbine assembly of claim 1, wherein the fluid medium is compressed air.

6. The compact turbine assembly of claim 1, wherein the fluid medium is combustion exhaust gas.

7. A compact turbine assembly, which comprises:

(a) a steam generator adapted to generate high pressure, superheated steam, wherein the steam generator comprises:

(i) a fire chamber;

(ii) at least one coiled boiler tubing housed within the fire chamber and provided with a fluid inlet and a fluid outlet;

(iii) hanger rods anchoring the boiler tubing in the fire chamber;

(iv) a burner port disposed at the lower portion of the fire chamber;

(v) a pressurized burner attached to the burner port for producing superheated steam in the upstream section of the boiler tubing;

(vi) a chimney with a draft regulator on the top portion of the fire chamber;

(vi) a feedwater tank mounted beneath the steam generator;

(vii) a pipe providing communication between the feedwater tank and the fluid inlet of the boiler tubing;

(viii) flow and pressure control means for controlling the flow and pressure of water in the pipe; and (ix) a pump for pumping water through the pipe; and (b) a turbine connected to the steam generating means, which comprises:

(i) a mounting support plate having a central bearing housing;

(ii) a power housing rim comprising two halves fixedly attached to the mounting support plate, the power housing rim having a plurality of alternate teeth and grooves disposed circumferentially along the inside surface of the power housing rim;

(iii) a power shaft rotatably mounted within the central bearing housing;

(iv) a rotor fixedly keyed onto the power shaft, the rotor having a series of steam-receiving cavities, each cavity having a side wall and a rounded closed end, the cavities being disposed at an angle along the outer circumferential surface of the rotor, the rotor including a plurality of circumferential alternate grooves and teeth which match respectively with the teeth and grooves of the power housing rim so as to form a labyrinth seal which defines a gap section between the power housing rim and the rotor, the cavities being in communication with the gap section and steam released by the cavities being entrained in the gap section, wherein the gap section entraps the steam during operation of the turbine in order to further drive the rotor and utilize the enthalpy of the steam;

(v) at least one inlet port provided on the power housing rim, for admitting the high pressure steam from the steam generating means, and a nozzle connected to the inlet port, for directing the steam to the rotor, wherein the inner wall of each steam-receiving cavity against which the steam first impinges is disposed at an obtuse angle along the outer circumferential surface of the rotor, as measured with respect to the direction of entry or the steam into each cavity from the nozzle, and wherein the outlet of the boiler tubing is attached to the inlet port to facilitate the feeding of the superheated steam produced in the upstream section of the boiler tubing into the turbine; and (vi) at least one exhaust port provided on the lower portion of the power housing rim, for passing used steam out of the turbine, the exhaust port being in communication with the gap section and the gap section providing an outflow path to the exhaust port for the steam entrained within the gap section, and the exhaust port being in communication with the tank;

wherein rotation of the rotor is caused by the impulse applied to each cavity by the superhead steam coming from the nozzle and thereafter by a reactive force against the power housing rim due to the entrapment of the steam in the cavities and the gap section, thereby utilizing the enthalpy of the steam.

* * * * *

UNITED STATES PATENT AND TRADEMARK OFFICE

CERTIFICATE OF CORRECTION

PATENT NO. : 5,245,822

DATED : September 21, 1993

INVENTOR(S) : Laguinia

It is certified that error appears in the above-identified patent and that said Letters Patent is hereby corrected as shown below:

Column 6, line 23, amend "or" to —of—.

Column 6, line 38, amend "superhead" to -- superheated--.

Signed and Sealed this

Fifth Day of April, 1994

Bruce Lehman

*Attest:*

BRUCE LEHMAN

*Attesting Officer*

*Commissioner of Patents and Trademarks*